US012352168B1

(12) United States Patent
Hu et al.

(10) Patent No.: US 12,352,168 B1
(45) Date of Patent: Jul. 8, 2025

(54) TERTIARY COOPERATIVE COMPRESSION YIELDING AND ENERGY-ABSORBING SUPPORT MECHANISM

(71) Applicant: China University of Mining and Technology-Beijing, Beijing (CN)

(72) Inventors: Jie Hu, Beijing (CN); Manchao He, Beijing (CN); Mingming Ren, Beijing (CN); Di Peng, Beijing (CN)

(73) Assignee: China University of Mining and Technology-Beijing, Beijing (CN)

( * ) Notice: Subject to any disclaimer, the term of this patent is extended or adjusted under 35 U.S.C. 154(b) by 0 days.

(21) Appl. No.: 19/024,017

(22) Filed: Jan. 16, 2025

(30) Foreign Application Priority Data

Sep. 26, 2024 (CN) ..... 202411350128.0

(51) Int. Cl.
*E21D 11/18* (2006.01)

(52) U.S. Cl.
CPC ..... *E21D 11/18* (2013.01)

(58) Field of Classification Search
CPC ..... E21D 11/22–367
See application file for complete search history.

(56) References Cited

U.S. PATENT DOCUMENTS 522,177 A * 6/1894 Holland ..... B63G 8/41 114/238
644,943 A * 3/1900 Pino ..... B63C 11/44 114/333
724,666 A * 4/1903 Cooper ..... E21D 9/0879 405/144
2024/0167383 A1 5/2024 Wei et al.

FOREIGN PATENT DOCUMENTS

CN 106812544 A * 6/2017 ..... E21D 11/18
CN 110206560 A 9/2019
CN 110847930 A * 2/2020
CN 111852505 A 10/2020
CN 112377220 A * 2/2021 ..... E21D 11/18
CN 116556987 A 8/2023
CN 116816391 A 9/2023

OTHER PUBLICATIONS

Zhang et al., CN 106812544 A, machine translation. (Year: 2017).*
Han et al., CN 110847930 A, machine translation. (Year: 2020).*
Yu et al., CN 112377220 A, machine translation. (Year: 2021).*

* cited by examiner

*Primary Examiner* — Tara Mayo

(57) ABSTRACT

A tertiary cooperative compression yielding and energy-absorbing support mechanism. The compression yielding and energy-absorbing anchor cables play a basic support role, and the circumferential compression yielding device can make the primary support compression yielding arch frame have a constant resistance deformation in the circumferential direction, while the primary support compression yielding arch frame and the secondary lining steel arch frame have a relative dislocation movement in the radial compression yielding device, and the tertiary compression yielding and energy-absorbing structures are cooperated with each other to adapt to the over-meter large deformation movement of the surrounding rock.

10 Claims, 5 Drawing Sheets

TERTIARY COOPERATIVE COMPRESSION YIELDING AND ENERGY-ABSORBING SUPPORT MECHANISM

CROSS REFERENCE TO RELATED APPLICATIONS

This application claims foreign priority of Chinese Patent Application No. 202411350128. 0, filed on Sep. 26, 2024 in the China National Intellectual Property Administration, the disclosures of all of which are hereby incorporated by reference.

TECHNICAL FIELD

The present disclosure relates to the technical field of tunnel support, and in particular to a tertiary cooperative compression yielding and energy-absorbing support mechanism.

BACKGROUND

Crossing fault fracture zone rock mass is a controlling node in the tunnel construction, and a major challenge is the large deformation of the surrounding rock. Being influenced by the extreme fracture of the fracture zone rock mass and the complete development of the cracks, the surrounding rock has a large deformation amount, high deformation rate, long convergence time, and even difficulty in convergence. The traditional support technology mostly adopts the composite rigid support system of the primary support and the secondary lining, the primary support layer mainly includes the anchor bolt/cable, the steel arch frame and the concrete layer, and the secondary lining layer is mainly the reinforced concrete layer. The primary support layer and the secondary lining layer rely on the sufficient stiffness and the strength to resist the large deformation of the fracture zone surrounding rock. Blindly strengthening the stiffness and the strength of the primary support layer and the secondary lining layer, under the action of high ground stress in the fault fracture zone, the primary support layer and the secondary lining layer will be subjected the great formation pressure, which can easily cause problems such as concrete damage, distortion of steel arch, dislocation of steel arch, inverted arch uplift of steel arch, and cracking of secondary lining. During the construction process, the support system needs to be replaced, which inevitably increases the construction investment cost.

In the prior art, there is also a retractable steel arch frame to replace the rigid steel arch frame, for example, the Chinese invention patent application publication number CN115306448A, which discloses a retractable tunnel support steel arch frame adapted to the deformation of surrounding rock. In the early stage of the steel arch frame structure, the compression property of the spring is used to make the deformation pressure acting on the main structure of the steel arch frame not to be too large, and in the later stage of the steel arch frame structure, after the surrounding rock stress redistribution is adjusted, the main structure of the steel arch frame is closely combined with the surrounding rock through the resilience property of the spring, so as to adapt to the appropriate deformation of the surrounding rock. Due to its steel arch frame mainly relies on the deformation of the spring to allow the compression yielding and energy-absorbing, which can lead to the following problems. Firstly, when the surrounding rock has the large deformation, the steel arch frame will be subjected greater stress, and when the stress is greater than the bearing limit of the spring, the spring will appear damage and lead to complete failure; secondly, after the spring is deformed, an elastic stress will always appear inside the steel arch frame, which makes the steel arch frame always in a high stress state, and is not conducive to the long-term stable and effective support of the steel arch frame; thirdly, the above-mentioned retractable steel arch frame has the weak resistance to deformation and the small deformation amount, which is only applicable to the small deformation tunnel/roadway; it is difficult for a single retractable steel arch frame to play an effective support role in the over-meter large deformation disaster of the fault fracture zone surrounding rock, when the fault surrounding rock has a large dislocation movement.

Accordingly, there is a need to provide an improved solution to the above-mentioned deficiencies of the prior art.

SUMMARY

It is an object of the present disclosure to provide a tertiary cooperative compression yielding and energy-absorbing support mechanism to at least solve the above-mentioned problems in the prior art.

In order to achieve the above-mentioned object, the present disclosure provides the following technical solutions:

a tertiary cooperative compression yielding and energy-absorbing support mechanism, wherein, including: compression yielding and energy-absorbing anchor cables, a primary support compression yielding arch frame and a secondary lining steel arch frame, wherein a plurality of the compression yielding and energy-absorbing anchor cables are located at a peripheral of the primary support compression yielding arch frame, and the primary support compression yielding arch frame is located at the peripheral of the secondary lining steel arch frame; and the compression yielding and energy-absorbing anchor cables are supported in a surrounding rock of the peripheral of the primary support compression yielding arch frame; and the primary support compression yielding arch frame is composed of a plurality of section steel units and a plurality of circumferential compression yielding devices, wherein the circumferential compression yielding devices are fixed between two adjacent section steel units, and the circumferential compression yielding devices include a circumferential outer frame and a circumferential inner frame, one end of the circumferential inner frame is extended into the circumferential outer frame, and the circumferential inner frame is guided to move along the circumferential outer frame; one of the circumferential outer frame and the circumferential inner frame is provided with a circumferential constant-resistance sleeve, the other of the circumferential outer frame and the circumferential inner frame is provided with a circumferential anchor cable, and one end of the circumferential anchor cable is penetrated into the circumferential constant-resistance sleeve, and the circumferential anchor cable being penetrated into the circumferential constant-resistance sleeve is provided with a constant-resistance slide mass, which is guided to slide with a constant resistance in the circumferential constant-resistance sleeve; and a plurality of radial compression yielding devices are provided between the primary support compression yielding arch frame and the secondary lining steel arch frame, and the radial compression yielding devices include an upper baffle plate and a lower baffle plate, one of the upper baffle plate and the lower baffle plate is provided for attaching to the primary support compression yielding arch frame, and the other of the upper baffle plate and the lower baffle plate is provided for attaching to the secondary lining steel arch frame; a radial outer frame and a radial inner frame are provided between the upper baffle plate and the lower baffle plate, one end of the radial inner frame is extended into the radial outer frame, and the radial inner frame is guided to move along the radial outer frame; one of the radial outer frame and the radial inner frame is provided with a radial inner sleeve, and the other of the radial outer frame and the radial inner frame is provided with a radial inner anchor cable, and one end of the radial inner anchor cable is penetrated into the radial inner sleeve, and the radial inner anchor cable being penetrated into the radial inner sleeve is provided with a slide mass, which is guided to slide with the constant resistance in the radial inner sleeve.

Advantageous Effects

In this tertiary cooperative compression yielding and energy-absorbing support mechanism, the compression yielding and energy-absorbing anchor cables play a basic support role, the circumferential compression yielding device can make the primary support compression yielding arch frame have a constant resistance deformation in the circumferential direction, while the radial compression yielding devices can make the primary support compression yielding arch frame and the secondary lining steel arch frame have a relative dislocation movement, and the tertiary compression yielding and energy-absorbing structures are cooperated with each other to adapt to the over-meter large deformation movement of the surrounding rock; the integrity of the secondary lining structure is ensured, and the tunnel clearance is not intruded; the over-meter large deformation caused by the deformation of the surrounding rock can be well controlled, and the deformation resistance of the tunnel space can be enhanced.

This tertiary cooperative compression yielding and energy-absorbing support mechanism can stabilize the subjected large deformation pressure of the surrounding rock and slowly perform the compression resistance type retraction of the primary support compression yielding arch frame, which reduces the possibility of damage to the compression resistance type arch frame locking structure due to the displacement and strong impact pressure; in addition, the effective control of tunnel compression resistance type pressure and tunnel surrounding rock extrusion deformation expansion rate and deformation size can avoid the bending and the breaking of multistage support structure due to the excessive compression resistance type pressure, so that the tertiary cooperative compression yielding and energy-absorbing support mechanism can better adapt to the the deformation of surrounding rock, on this basis, it also ensure that the three-level tertiary cooperative compression yielding and energy-absorbing support mechanism can always play a better role in support, improve the security of the whole three-level tertiary cooperative compression yielding and energy-absorbing support mechanism, and help to reduce the economic losses.

LABLES AND DESCRIPTIONS

1-surrounding rock; 2-compression yielding and energy-absorbing anchor cable; 3-primary support compression yielding arch frame; 4-circumferential compression yielding device; 5-radial compression yielding device; 6-concrete; 7-secondary lining steel arch frame; 8-tunnel clearance; 9-section steel unit; 201-anchorage clip; 202-anchor ring; 203-tray; 204-slide mass; 205-constant-resistance sleeve; 206-steel strand; 207-resin anchoring agent; 401-circumferential inner frame top plate; 402-circumferential inner frame; 403-sleeve fixing base; 404-circumferential anchor ring; 405-constant-resistance slide mass; 406-circumferential constant-resistance sleeve; 407-circumferential anchor cable; 408-circumferential anchorage clip; 409-circumferential outer frame; 4010-circumferential outer frame bottom plate; 501-upper baffle plate; 502-radial inner frame; 503-radial inner anchor cable; 504-connection piece; 505-radial outer anchor cable; 506-radial inner sleeve; 507-radial outer frame; 508-protective sleeve; 509-radial outer sleeve; 5010-lower baffle plate.

DETAILED DESCRIPTION OF THE EMBODIMENTS

Figure 1:
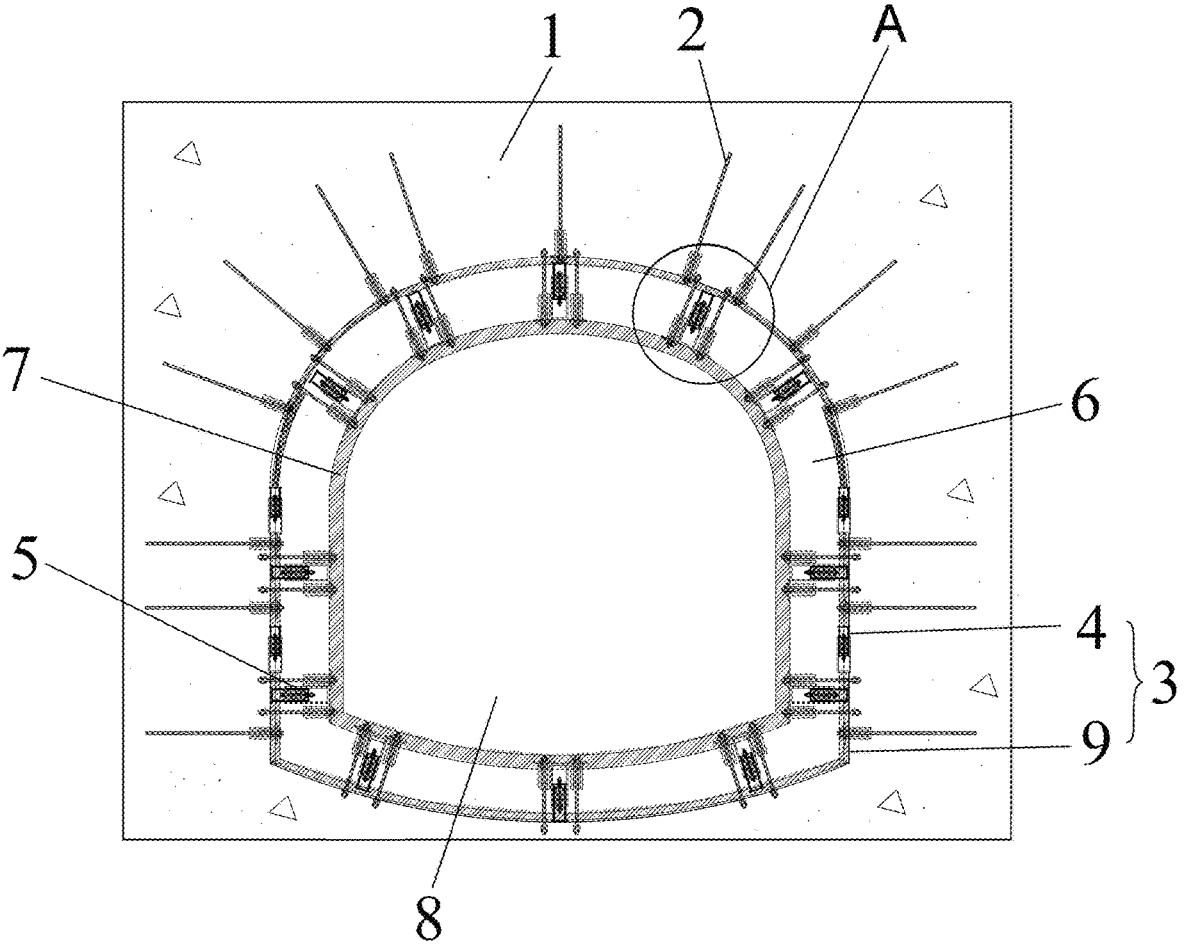
FIG. 1 is a structure schematic diagram of a tertiary cooperative compression yielding and energy-absorbing support mechanism according to an embodiment of the present disclosure.
Figure 2:
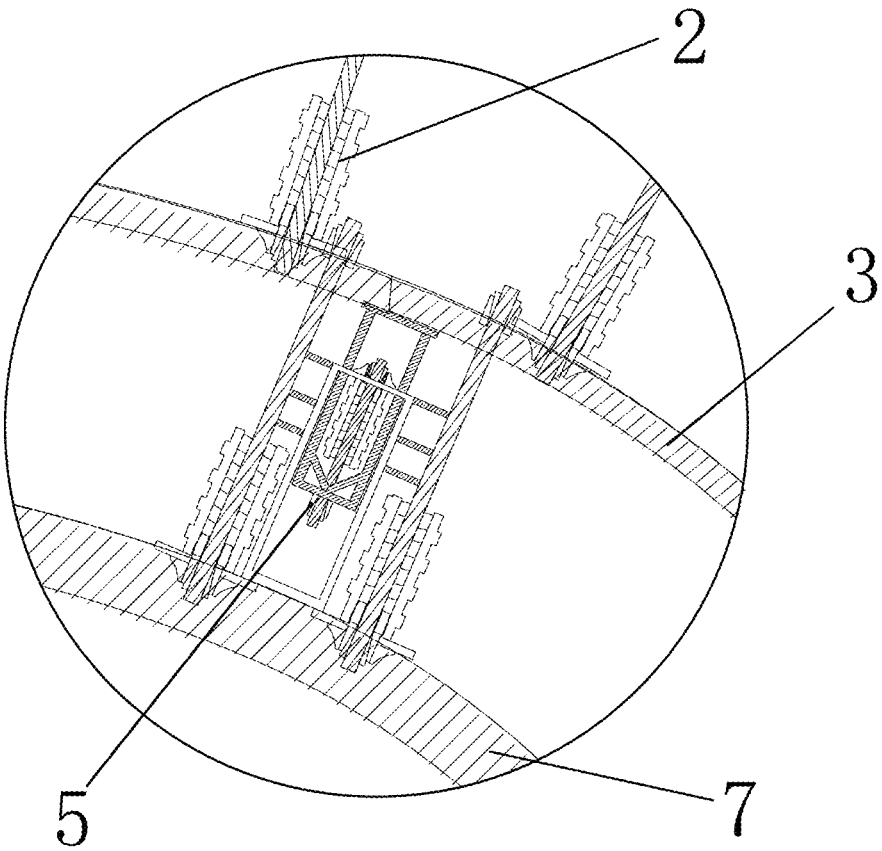
FIG. 2 is an enlarged view at A of FIG. 1 according to an embodiment of the present disclosure.
Figure 3:
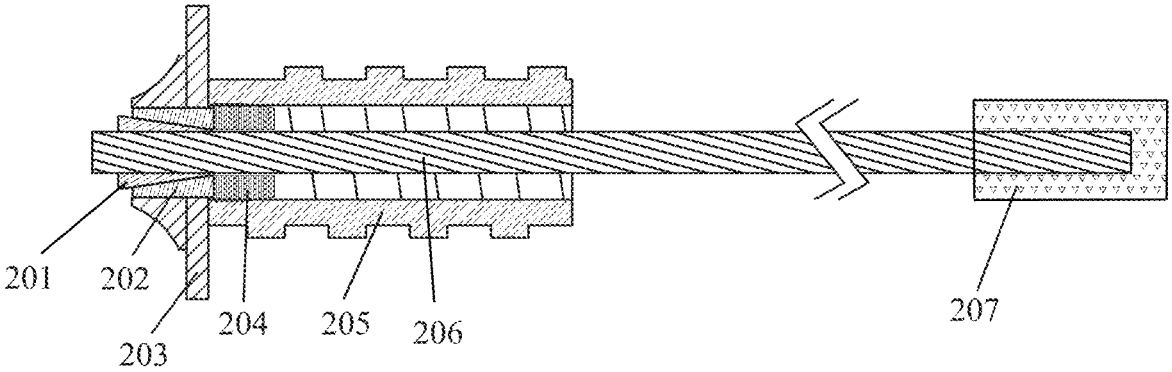
FIG. 3 is a structure schematic diagram of a compression yielding and energy-absorbing anchor cable according to an embodiment of the present disclosure.
Figure 4A:
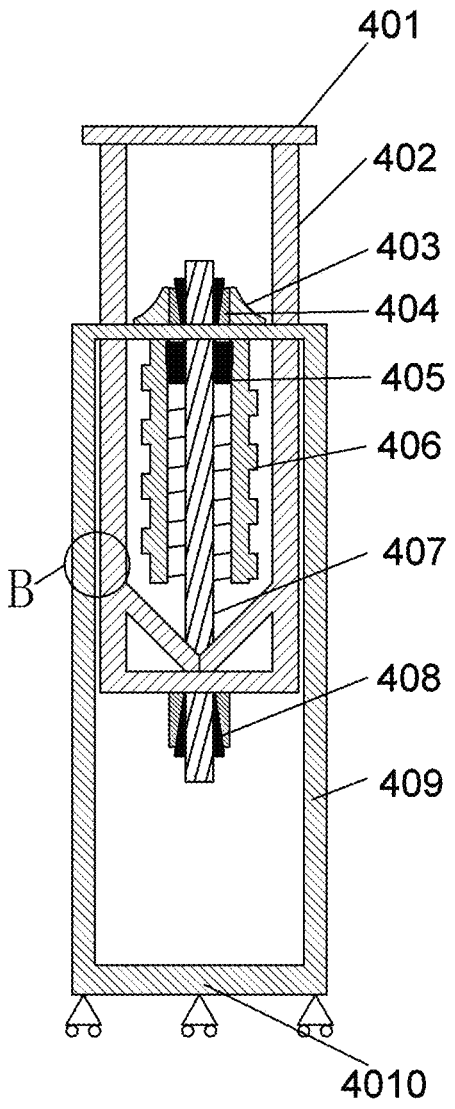
FIG. 4A and FIG. 4B are structure schematic diagrams of a circumferential compression yielding device according to an embodiment of the present disclosure.
Figure 4B:
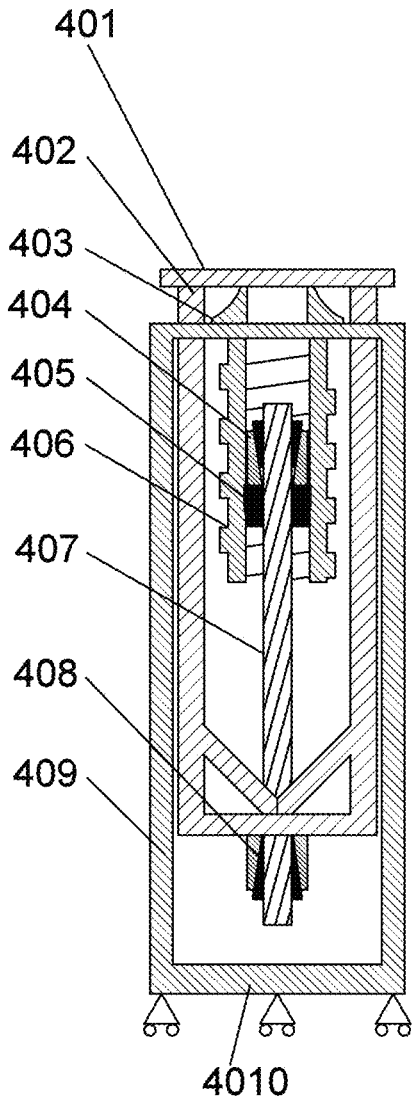
Figure 5:
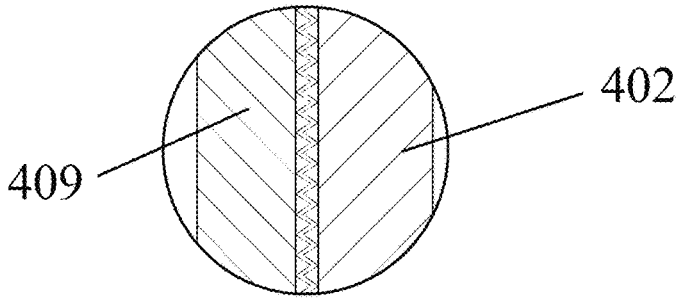
FIG. 5 is an enlarged view at B of FIG. 4A according to an embodiment of the present disclosure.
Figure 6A:
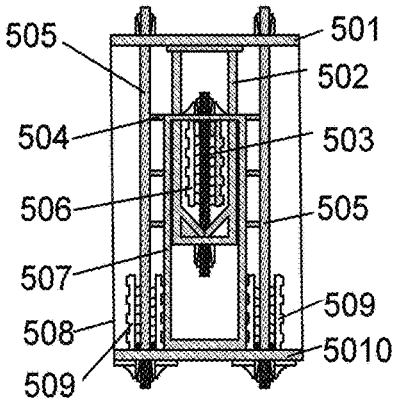
FIG. 6A, FIG. 6B and FIG. 6C are structure schematic diagrams of a radial compression yielding device according to an embodiment of the present disclosure.
Figure 6B:
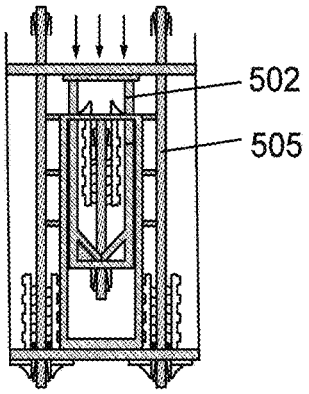
Figure 6C:
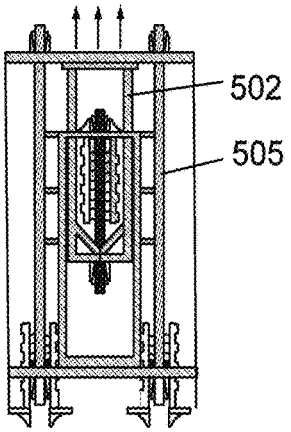
Figure 7:
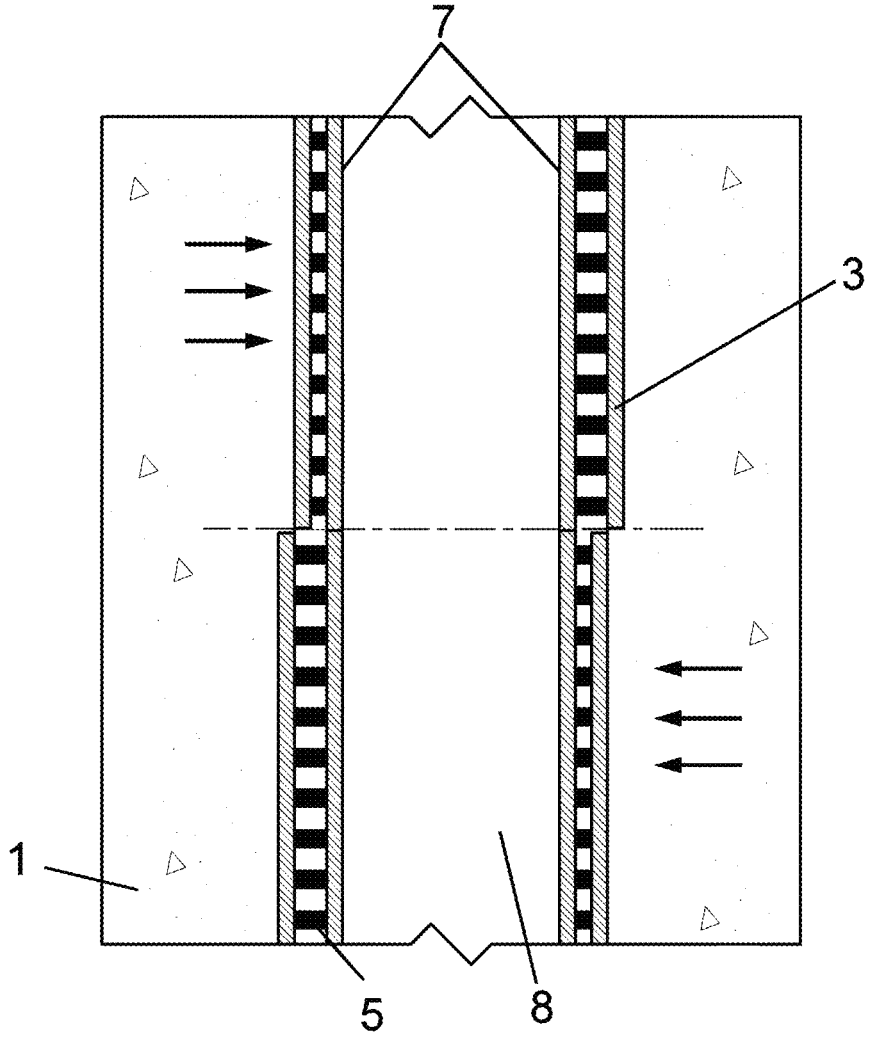
FIG. 7 is a tunnel axial cross-sectional view during a large deformation of surrounding rock according to an embodiment of the present disclosure.

According to specific embodiments of the present disclosure, as shown in FIGS. 1-7, the present disclosure provides a tertiary cooperative compression yielding and energy-absorbing support mechanism, which includes compression yielding and energy-absorbing anchor cables 2, a primary support compression yielding arch frame 3 and a secondary lining steel arch frame 7, wherein a plurality of the compression yielding and energy-absorbing anchor cables 2 are located at a peripheral of the primary support compression yielding arch frame 3, and the primary support compression yielding arch frame 3 is located at the peripheral of the secondary lining steel arch frame 7.

The compression yielding and energy-absorbing anchor cables 2 are supported in a surrounding rock 1 of the peripheral of the primary support compression yielding arch frame 3; in this embodiment, the compression yielding and energy-absorbing anchor cables 2 include an anchorage clip 201, an anchor ring 202, a tray 203, a slide mass 204, a constant-resistance sleeve 205, a steel strand 206 and a resin anchoring agent 207; specifically, a hole is firstly drilled on the surrounding rock 1, then the resin anchoring agent 207 is placed at a bottom of the drilled hole, then the constant-resistance sleeve 205 and the tray 203 are installed at the opening of the drilling hole, and the slide mass 204, the anchor ring 202 and the anchor clip 201 are installed in sequence at the end of the steel strand 206, then the bottom end of the steel strand 206 is inserted into the resin anchoring agent 207 at the bottom of the drilled hole, and the steel strand 206 is stirred, so that the end thereof is anchored in the drilled hole via the resin anchoring agent 207, at this time, one end of the steel strand 206, on which the slide mass 204 is installed, is inserted into the constant-resistance sleeve 205.

The primary support compression yielding arch frame 3 is composed of a plurality of section steel units 9 and a plurality of circumferential compression yielding devices 4, wherein the circumferential compression yielding devices 4 are fixed between two adjacent section steel units 9, and the circumferential compression yielding devices 4 include a circumferential outer frame 409 and a circumferential inner frame 402, one end of the circumferential inner frame 402 is extended into the circumferential outer frame 409, and the circumferential inner frame 402 is guided to move along the circumferential outer frame 409; one of the circumferential outer frame 409 and the circumferential inner frame 402 is provided with a circumferential constant-resistance sleeve 406, the other of the circumferential outer frame 409 and the circumferential inner frame 402 is provided with a circumferential anchor cable 407, and one end of the circumferential anchor cable 407 is penetrated into the circumferential constant-resistance sleeve 406, and the circumferential anchor cable 407 being penetrated into the circumferential constant-resistance sleeve 406 is provided with a constant-resistance slide mass 405, which is guided to slide with a constant resistance in the circumferential constant-resistance sleeve 406.

In this embodiment, both ends of the circumferential anchor cable 407 are fixed and limited through a circumferential anchor ring 404 and a circumferential anchorage clip 408.

A plurality of radial compression yielding devices 5 are provided between the primary support compression yielding arch frame 3 and the secondary lining steel arch frame 7, and the radial compression yielding devices 5 include an upper baffle plate 501 and a lower baffle plate 5010, one of the upper baffle plate 501 and the lower baffle plate 5010 is provided for attaching to the primary support compression yielding arch frame 3, and the other of the upper baffle plate 501 and the lower baffle plate 5010 is provided for attaching to the secondary lining steel arch frame 7; a radial outer frame 507 and a radial inner frame 502 are provided between the upper baffle plate 501 and the lower baffle plate 5010, one end of the radial inner frame 502 is extended into the radial outer frame 507, and the radial inner frame 502 is guided to move along the radial outer frame 507; one of the radial outer frame 507 and the radial inner frame 502 is provided with a radial inner sleeve 506, and the other of the radial outer frame 507 and the radial inner frame 502 is provided with a radial inner anchor cable 503, and one end of the radial inner anchor cable 503 is penetrated into the radial inner sleeve 506, and the radial inner anchor cable 503 being penetrated into the radial inner sleeve 506 is provided with a slide mass, which is guided to slide with the constant resistance in the radial inner sleeve 506.

In this tertiary cooperative compression yielding and energy-absorbing support mechanism, the compression yielding and energy-absorbing anchor cables 2 serve as the first-stage compression yielding and energy-absorbing structure, the circumferential compression yielding device 4 in the primary support compression yielding arch frame 3 serves as the second-stage compression yielding and energy-absorbing structure, and the radial compression yielding devices 5 between the primary support compression yielding arch frame 3 and the secondary lining steel arch frame 7 serve as the third-stage compression yielding and energy-absorbing structure.

Wherein, in the first-stage compression yielding and energy-absorbing structure, the compression yielding and energy-absorbing anchor cables 2 being provided in the surrounding rock 1 play a preliminary role in supporting the surrounding rock 1 of the tunnel.

In the second-stage compression yielding and energy-absorbing structure, when the surrounding rock 1 has the small deformation, the surrounding rock 1 transmits the pressure to the primary support compression yielding arch frame 3, and the primary support compression yielding arch frame 3 transmits the subjected pressure to the circumferential compression yielding device 4. Under the pressure, the circumferential inner frame 402 has a displacement motion relative to the circumferential outer frame 409, so that the circumferential inner frame 402 is retracted into the circumferential outer frame 409; the circumferential inner frame 402 drives the circumferential anchor cable 407 and the constant-resistance slide mass 405 to move downwards, and the constant-resistance slide mass 405 and the circumferential constant-resistance sleeve 406 have the constant-resistance friction, playing a role in constant-resistance energy dissipation; during the constant-resistance deformation process of the circumferential compression yielding device 4, there will be no significant internal stress generated within the circumferential compression yielding device 4, ensuring that the arch frame can provide the constant support effect throughout the deformation entire process of the surrounding rock 1.

In the third-stage compression yielding and energy-absorbing structure, when the surrounding rock 1 has the over-meter large deformation, the surrounding rock 1 on the both sides of the fault moves moves in a staggered manner. At this time, the large deformation force of the surrounding rock 1 is transmitted to the radial compression yielding devices 5, and the radial outer frame 507 and the radial inner frame 502 inside the radial compression yielding devices 5 are relatively displaced under the pressure. The radial inner frame 502 is retracted into the radial outer frame 507, and the radial outer frame 507 and the radial inner frame 502 convert the subjected pressure to the tension on the radial inner sleeve 506 and the radial inner anchor cable 503, so that the slide mass and the radial inner sleeve 506 have the constant-resistance friction, playing a role in the constant-resistance energy dissipation.

That is to say, the compression yielding and energy-absorbing anchor cables 2 play a basic support role, the circumferential compression yielding device 4 can make the primary support compression yielding arch frame 3 have a constant resistance deformation in the circumferential direction, while the radial compression yielding devices 5 can make the primary support compression yielding arch frame 3 and the secondary lining steel arch frame 7 have a relative dislocation movement, and the tertiary compression yielding and energy-absorbing structures are cooperated with each other to adapt to the over-meter large deformation movement of the surrounding rock 1; the integrity of the secondary lining structure is ensured, and the tunnel clearance 8 is not intruded; the over-meter large deformation caused by the deformation of the surrounding rock 1 can be well controlled, and the deformation resistance of the tunnel space can be enhanced.

And this tertiary cooperative compression yielding and energy-absorbing support mechanism can stabilize the subjected large deformation pressure of the surrounding rock 1 and slowly perform the compression resistance type retraction of the primary support compression yielding arch frame 3, which reduces the possibility of damage to the compression resistance type arch frame locking structure due to the displacement and strong impact pressure; in addition, the effective control of tunnel compression resistance type pressure and tunnel surrounding rock extrusion deformation expansion rate and deformation size can avoid the bending and the breaking of multistage support structure due to the excessive compression resistance type pressure, so that the tertiary cooperative compression yielding and energy-absorbing support mechanism can better adapt to the the deformation of surrounding rock 1, on this basis, it also ensure that the three-level tertiary cooperative compression yielding and energy-absorbing support mechanism can always play a better role in support, improve the security of the whole three-level tertiary cooperative compression yielding and energy-absorbing support mechanism, and help to reduce the economic losses.

A plurality of radial outer anchor cables 505 and a plurality of radial outer sleeves 509 are further provided between the upper baffle plate 501 and the lower baffle plate 5010, and one end of the radial outer anchor cables 505 is provided with the slide mass and is inserted into the radial outer sleeves 509; and a plurality of the radial outer sleeves 509 and the radial outer frame 507 are arranged side-by-side on a same side, and an arrangement direction of the radial outer sleeves 509 are opposite to the arrangement direction of the radial inner sleeve 506; and a plurality of the radial outer sleeves 509 are evenly distributed on the peripheral of the radial outer frame 507.

In one embodiment of the present disclosure, at least two sets of the radial outer anchor cables 505 and the radial outer sleeves 509 are uniformly distributed on the peripheral of the radial outer frame 507, the arrangement direction of the radial outer sleeves 509 is opposite to the arrangement direction of the radial inner sleeve 506, so that the slide mass inside the radial outer sleeves 509 and the slide mass inside the radial inner sleeve 506 move along the opposite directions, thereby enabling the primary support compression yielding arch frame 3 to have a bidirectional constant-resistance yielding capability.

In this embodiment, both ends of the radial outer anchor cables 505 and the radial inner anchor cable 503 are fixed and limited by the anchor ring and the anchorage clip, which will not be repeated here.

The radial outer frame 507 and the radial outer anchor cables 505 are relatively fixedly connected through a connection piece 504. In one embodiment of the present disclosure, the connection piece 504 can be a section steel structure, and both ends of the connection piece 504 are welded and fixed to the radial outer anchor cables 505 and the radial outer frame 507 respectively, so that the radial outer anchor cables 505 and the radial outer frame 507 can move synchronously.

The radial inner frame 502 is fixedly connected to the upper baffle plate 501, and the radial outer frame 507 is fixedly connected to the lower baffle plate 5010. In one embodiment of the present disclosure, the top plate of the radial inner frame 502 is fixed on the upper baffle plate 501, and the bottom plate of the radial outer frame 507 is fixed on the lower baffle plate 5010.

The upper baffle plate 501 is fixed on the primary support compression yielding arch frame 3, and the lower baffle plate 5010 is attached to outside of the secondary lining steel arch frame 7; and the radial outer sleeves 509 are fixed on the secondary lining steel arch frame 7.

In one embodiment of the present disclosure, the lower baffle plate 5010 is only attached to the outside of the secondary lining steel arch frame 7 and not directly fixed to the secondary lining steel arch frame 7, while the radial outer sleeves 509 are fixed to the secondary lining steel arch frame 7, allowing the lower baffle plate 5010 to move relative to the radial outer sleeves 509 and facilitating the bidirectional compression yielding of the radial compression yielding devices 5.

Specifically, when the surrounding rock 1 has a significant over-meter large deformation, the surrounding rock 1 on both sides of the fault will be displaced from each other, and the primary support compression yielding arch frame 3 will be subjected to greater stress, causing the significant displacement of the primary support compression yielding arch frame 3 relative to the secondary lining steel arch frame 7 along the deformation direction of the surrounding rock 1, and one side of the primary support compression yielding arch frame 3 is close to the secondary lining steel arch frame 7, so as to compress the radial compression yielding devices 5, while the other side of the primary support compression yielding arch frame 3 is far away from the secondary lining steel arch frame 7, so as to stretch the radial compression yielding devices 5. Therefore, on the basis of eliminating the over-meter large deformation of the surrounding rock 1, the secondary lining steel arch frame 7 is kept in its original position as much as possible, thus ensuring the safety and stability of the tunnel clearance 8 as much as possible.

Wherein, when the radial compression yielding devices 5 are compressed, the upper baffle plate 501 is subjected to pressure from the primary support compression yielding arch frame 3, and the upper baffle plate 501 is moved inward towards the lower baffle plate 5010. At this time, the circumferential inner frame 402 is moved towards the circumferential outer frame 409, and the circumferential constant-resistance sleeve 406 and its matching constant-resistance slide mass 405 play a role in constant-resistance and compression yielding to adapt to the movement of one side of the primary support compression yielding arch frame 3 towards the secondary lining steel arch frame 7.

When the radial compression yielding devices 5 are stretched, the upper baffle plate 501 is subjected to the tensile force of the primary support compression yielding arch frame 3, and the upper baffle plate 501 is moved outward in a direction away from the lower baffle plate 5010. At this time, the upper baffle plate 501 drives the radial outer anchor cables 505 to move outward, thereby allowing the radial constant-resistance sleeve and its matching slide mass to play a role in constant-resistance and compression yielding to adapt to the movement of the other side of the primary support compression yielding arch frame 3 away from the secondary lining steel arch frame 7; during this process, the radial outer anchor cables 505 drive the radial outer frame 507 to move synchronously via the connection piece 504, thereby maintaining the relative stability between the radial outer frame 507 and the radial inner frame 502.

In summary, the radial compression yielding devices 5 have a bidirectional compression yielding effect, which enables the tertiary cooperative compression yielding and energy-absorbing support mechanism to better adapt to the large deformation of the surrounding rock 1.

The outside of the radial compression yielding devices 5 is provided with a protective sleeve 508. In one embodiment of the present disclosure, the protective sleeve 508 can be made of materials such as engineering plastics or iron sheets, and the protective sleeve 508 is used to prevent the debris from intruding the radial compression yielding devices 5 and ensure the effectiveness of the radial compression yielding devices 5.

A concrete 6 is filled between the primary support compression yielding arch frame 3 and the secondary lining steel arch frame 7. In one embodiment of the present disclosure, the concrete 6 with a certain strength is filled between the primary support compression yielding arch frame 3 and the secondary lining steel arch frame 7 to provide better comprehensive support effect; wherein the protective sleeve 508 externally sleeved on the radial compression yielding devices 5 can prevent the intrusion of the concrete; in this embodiment, a foam concrete can be filled within a certain range of the peripheral of the radial compression yielding devices 5, which can avoid that when the primary support compression yielding arch frame 3 and the secondary lining steel arch frame 7 have a relative displacement, the foam concrete has a small strength and is easy to deform, thus ensuring that the foam concrete will not have a greater impact on the radial compression yielding devices 5 at the peripheral of the radial compression yielding devices 5, and providing a sufficient deformation space for the radial compression yielding devices 5.

Both sides of a top plate of the circumferential outer frame 409 are defined with each perforation, and two perforations are respectively penetrated by both side edges of the circumferential inner frame 402; and both sides of the top plate of the radial outer frame 507 are defined with each perforation, and two perforations are respectively penetrated by both side edges of the radial inner frame 502. In one embodiment of the present disclosure, both side edges of the circumferential inner frame 402 are guided to move along the perforations of the top plate of the circumferential outer frame 409, so as to ensure a more stable relative movement of the circumferential inner frame 402 to the circumferential outer frame 409; both side edges of the radial inner frame 502 are guided to move along the perforations of the top plate of the radial outer frame 507, so as to ensure a more stable relative movement of the radial inner frame 502 to the radial outer frame 507.

A mutual contact surface between the circumferential outer frame 409 and the circumferential inner frame 402 are provided with constant-resistance friction structures, and the mutual contact surface between the radial outer frame 507 and the radial inner frame 502 are provided with the constant-resistance friction structures; and the constant-resistance friction structures are regularly arranged triangle cross-sectional protrusions or rectangular cross-sectional protrusions, the constant-resistance friction structures on an outer support frame and an inner support frame are relatively arranged in a staggered manner.

In one embodiment of the present disclosure, the triangle cross-sectional protrusions or the rectangular cross-sectional protrusions can not only increase the frictional acting force between the outer frame and the inner frame, but also provide stability for the outer frame and the inner frame when they are relatively stationary, as the protrusions on the the outer frame and the inner frame are aligned with each other when they are relatively stationary.

The circumferential compression yielding devices 4 are provided on vertical edges of both sides of the primary support compression yielding arch frame 3, and the vertical edges are provided with a plurality of the circumferential compression yielding devices 4. In one embodiment of the present disclosure, the circumferential compression yielding device 4 is located in the vertical edge of the primary support compression yielding arch frame 3, which is convenient for the primary support compression yielding arch frame 3 to transmit the pressure subjected from the surrounding rock 1 to the circumferential compression yielding device 4, so that circumferential compression yielding device 4 can convert the subjected pressure into the tensile force between the constant-resistance sleeve and the anchor cable, enabling the circumferential compression yielding device 4 to better to play a role in constant-resistance and compression yielding. Two circumferential compression yielding devices 4 are provided on the vertical edges of the primary support compression yielding arch frame 3, and the compression yielding stroke of each circumferential compression yielding device 4 is a relative displacement stroke between the outer frame and the inner frame. Every time one circumferential compression yielding device 4 is added in the primary support compression yielding arch frame 3, one compression yielding stroke is added in the primary support compression yielding arch frame 3, improving the ability of the primary support compression yielding arch frame 3 to adapt to the deformation of the surrounding rock 1.

In this embodiment, the top plate of the circumferential outer frame 409 is provided with a sleeve fixing base 403, the circumferential constant-resistance sleeve is passed through the circumferential outer frame 409 and is fixed on the sleeve fixing base 403, and the circumferential inner frame top plate 401 and the circumferential outer frame bottom plate 4010 are used to connect between the section steel units 9 of the primary support compression yielding arch frame 3.

In this embodiment, the inner sides of the bottom of the circumferential inner frame 402 and the radial inner frame 502 are obliquely provided with reinforcement plates. The inclined reinforcement plates are arranged in pairs, and avoidance holes are provided on the reinforcement plates for the anchor cable to pass through, which are used for improving the structural strength of the inner frame.

What is claimed is:

1. A tertiary cooperative compression yielding and energy-absorbing support mechanism, comprising: compression yielding and energy-absorbing anchor cables, a primary support compression yielding arch frame and a secondary lining steel arch frame, wherein a plurality of the compression yielding and energy-absorbing anchor cables are located at a peripheral of the primary support compression yielding arch frame, and the primary support compression yielding arch frame is located at the peripheral of the secondary lining steel arch frame; and the compression yielding and energy-absorbing anchor cables are supported in a surrounding rock of the peripheral of the primary support compression yielding arch frame; and the primary support compression yielding arch frame is composed of a plurality of section steel units and a plurality of circumferential compression yielding devices, wherein the circumferential compression yielding devices are fixed between two adjacent section steel units, and the circumferential compression yielding devices comprise a circumferential outer frame and a circumferential inner frame, one end of the circumferential inner frame is extended into the circumferential outer frame, and the circumferential inner frame is guided to move along the circumferential outer frame; one of the circumferential outer frame and the circumferential inner frame is provided with a circumferential constant-resistance sleeve, the other of the circumferential outer frame and the circumferential inner frame is provided with a circumferential anchor cable, and one end of the circumferential anchor cable is penetrated into the circumferential constant-resistance sleeve, and the circumferential anchor cable being penetrated into the circumferential constant-resistance sleeve is provided with a constant-resistance slide mass, which is guided to slide with a constant resistance in the circumferential constant-resistance sleeve; and a plurality of radial compression yielding devices are provided between the primary support compression yielding arch frame and the secondary lining steel arch frame, and the radial compression yielding devices comprise an upper baffle plate and a lower baffle plate, one of the upper baffle plate and the lower baffle plate is provided for attaching to the primary support compression yielding arch frame, and the other of the upper baffle plate and the lower baffle plate is provided for attaching to the secondary lining steel arch frame; a radial outer frame and a radial inner frame are provided between the upper baffle plate and the lower baffle plate, one end of the radial inner frame is extended into the radial outer frame, and the radial inner frame is guided to move along the radial outer frame; one of the radial outer frame and the radial inner frame is provided with a radial inner sleeve, and the other of the radial outer frame and the radial inner frame is provided with a radial inner anchor cable, and one end of the radial inner anchor cable is penetrated into the radial inner sleeve, and the radial inner anchor cable being penetrated into the radial inner sleeve is provided with a slide mass, which is guided to slide with the constant resistance in the radial inner sleeve.

2. The tertiary cooperative compression yielding and energy-absorbing support mechanism according to claim 1, wherein, a plurality of radial outer anchor cables and a plurality of radial outer sleeves are further provided between the upper baffle plate and the lower baffle plate, and one end of the radial outer anchor cables is provided with the slide mass and is inserted into the radial outer sleeves; and a plurality of the radial outer sleeves and the radial outer frame are arranged side-by-side on a same side, and an arrangement direction of the radial outer sleeves is opposite to the arrangement direction of the radial inner sleeve; and a plurality of the radial outer sleeves are evenly distributed on the peripheral of the radial outer frame.

3. The tertiary cooperative compression yielding and energy-absorbing support mechanism according to claim 2, wherein, the radial outer frame and the radial outer anchor cables are relatively fixedly connected through a connection piece.

4. The tertiary cooperative compression yielding and energy-absorbing support mechanism according to claim 3, wherein, the radial inner frame is fixedly connected to the upper baffle plate, and the radial outer frame is fixedly connected to the lower baffle plate.

5. The tertiary cooperative compression yielding and energy-absorbing support mechanism according to claim 4, wherein, the upper baffle plate is fixed on the primary support compression yielding arch frame, and the lower baffle plate is attached to an outside of the secondary lining steel arch frame; and the radial outer sleeves are fixed on the secondary lining steel arch frame.

6. The tertiary cooperative compression yielding and energy-absorbing support mechanism according to claim 5, wherein, the outside of the radial compression yielding device is provided with a protective sleeve.

7. The tertiary cooperative compression yielding and energy-absorbing support mechanism according to claim 6, wherein, a concrete is filled between the primary support compression yielding arch frame and the secondary lining steel arch frame.

8. The tertiary cooperative compression yielding and energy-absorbing support mechanism according to claim 1, wherein, both sides of a top plate of the circumferential outer frame are respectively defined with two perforations, and the two perforations of the circumferential outer frame are respectively penetrated by both side edges of the circumferential inner frame; and both sides of the top plate of the radial outer frame are respectively defined with two perforations, and the two perforations of the radial outer frame are respectively penetrated by both side edges of the radial inner frame.

9. The tertiary cooperative compression yielding and energy-absorbing support mechanism according to claim 8, wherein, a mutual contact surface between the circumferential outer frame and the circumferential inner frame are provided with constant-resistance friction structures, and the mutual contact surface between the radial outer frame and the radial inner frame are provided with the constant-resistance friction structures; and the constant-resistance friction structures are regularly arranged triangle cross-sectional protrusions or rectangular cross-sectional protrusions, the constant-resistance friction structures on an outer support frame and an inner support frame are relatively arranged in a staggered manner.

10. The tertiary cooperative compression yielding and energy-absorbing support mechanism according to claim 1, wherein, the circumferential compression yielding devices are provided on vertical edges of both sides of the primary support compression yielding arch frame, and the vertical edges are provided with a plurality of the circumferential compression yielding devices.

* * * * *